US005290660A

United States Patent [19]

Eian et al.

[11] Patent Number: 5,290,660

[45] Date of Patent: Mar. 1, 1994

[54] DYE PERMEABLE POLYMER INTERLAYERS

[75] Inventors: Gilbert L. Eian, Mahtomedi; Takuzo Ishida, Woodbury; Alan M. Miller, Cottage Grove, all of Minn.

[73] Assignee: Minnesota Mining and Manufacturing Company, Saint Paul, Minn.

[21] Appl. No.: 52,947

[22] Filed: Apr. 23, 1993

[51] Int. Cl.[5] ..... G03C 5/54; G03C 1/72; G03C 7/20

[52] U.S. Cl. ..... 430/203; 430/201; 430/213; 430/214; 430/215; 430/333

[58] Field of Search ..... 430/201, 203, 213, 214, 430/215, 333, 505

[56] References Cited

U.S. PATENT DOCUMENTS

| | | | |
|---|---|---|---|
| 4,021,240 | 5/1977 | Cerqune et al. | 430/203 |
| 4,460,681 | 7/1984 | Frenchik | 430/502 |
| 4,474,867 | 10/1984 | Naito et al. | 430/203 |
| 4,483,914 | 11/1984 | Naito et al. | 430/203 |
| 4,507,380 | 3/1985 | Naito et al. | 430/203 |
| 4,594,307 | 6/1986 | Ishida et al. | 430/203 |
| 4,883,747 | 11/1989 | Grieve et al. | 430/542 |
| 4,923,792 | 5/1990 | Grieve et al. | 430/559 |
| 5,077,178 | 12/1991 | Herbert et al. | 430/340 |
| 5,206,112 | 4/1993 | Cotner et al. | 430/203 |

*Primary Examiner*—Richard L. Schilling
*Attorney, Agent, or Firm*—Gary L. Griswold; Walter N. Kirn; Gregory A. Evearitt

[57] ABSTRACT

Blends of poly(caprolactone) and poly(vinyl chloride) have been found to have good dye permeability. They have been incorporated into photothermographic constructions as barrier interlayers and dye-receiving layers.

25 Claims, No Drawings

DYE PERMEABLE POLYMER INTERLAYERS

FIELD OF THE INVENTION

This invention relates to the use of blends of poly(caprolactone) and poly(vinyl chloride) as interlayers and as image-receiving layers in imageable articles.

BACKGROUND OF THE ART

High quality three color photothermographic silver halide (i.e., dry silver) imaging constructions based on diffusion transfer of imaging dyes from imaging layers to a strippable image-receiving layer are known in the art. Those multilayer constructions require barrier interlayers between the imaging layers to prevent penetration of upper layers into the lower layers during solvent coating and drying operations, and to prevent crosstalk during development of the latent image following exposure. However, the barrier interlayers must also allow transfer of imaging dyes (formed during development) by diffusion to the image-receiving layer.

It is also desirable that the polymer coated as the image-receiving layer have high permeability to imaging dyes. In full color dry silver constructions, the various imaging dyes often have widely different chemical structures and, therefore, quite different tendencies to migrate in polymer films.

Dry silver compositions or emulsions are photothermographic compositions, and contain a light-insensitive, reducible silver source; a light-sensitive silver source; and a reducing agent for the light-insensitive, reducible silver source. The light-sensitive material is generally photographic silver halide, which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the light-insensitive, reducible silver source by the reducing agent. It has been long understood that silver ($Ag^{\circ}$) is a catalyst for the reduction of silver ions and the silver-generating light-sensitive silver halide catalyst progenitor may be placed into catalytic proximity with the silver source in a number of different fashions, such as by partial metathesis of the light-insensitive, reducible silver source with a halogen-containing source, coprecipitation of silver halide and light-insensitive, reducible silver source material, and other methods that intimately associate the silver halide and the silver source.

In both photographic and photothermographic emulsions, exposure of the photographic silver halide to light produces small clusters of silver atoms. The image-wise distribution of these clusters is known in the art as a latent image. This latent image generally is not visible by ordinary means, and the light-sensitive article must be further processed to produce a visual image. The visual image is produced by the catalytic reduction of silver ions, which are in catalytic proximity to the silver halide grains bearing the latent image.

Typically, in color dry silver imaging systems a leuco dye is incorporated as a reducing agent for the light-insensitive, reducible silver source, generally in combination with a spectral sensitizer for the silver halide. The leuco dye is oxidized to form a dye upon development, thereby giving a colored image. In full color constructions, spectrally-sensitized emulsion layers containing yellow, magenta, and cyan leuco dyes are typically coated onto a substrate and separated by one or more barrier interlayers.

Residual silver stain is a major problem with dry silver color constructions known in the art. This has been overcome by causing the developed dye image to diffuse from the dry silver layer to an image-receiving layer that is then stripped from the emulsion layer(s). In this case, a barrier interlayer must serve the dual roles of separating the chemistry of neighboring emulsion layers, and allowing diffusion of the dye image under thermal processing conditions.

Depending on the particular ingredients of a given dry silver layer, the development may be best carried out, for example, under acidic or basic conditions.

When multiple dry silver layers with incompatible developing chemistries are employed, it is very difficult to keep development conditions within the dry silver layer from affecting the development of nearby or adjacent dry silver layers. As a result, it is advantageous to coat dry silver layers with different developing conditions on opposite sides of a transparent substrate.

U.S. Pat. No. 4,594,307 discloses a heat developable photographic material that produces a pure and stable dye image by the oxidation-reduction reaction between a reducible organic silver salt and a leuco dye reducing agent wherein the dye image formed is transferred to an image-receiving layer by continuing the heating for development to separate the dye image formed from the silver images and other residual chemicals. However, this material is not capable of producing a multiple color or full color image on the same substrate.

The generation of color dry silver images has been accomplished using microencapsulated constructions and tri-pack (yellow/magenta/cyan) multilayer constructions, such as those disclosed in U.S. Pat. Nos. 4,883,747 and 4,923,792. The cited patents above employed S-97 Gantrez TM polystyrene, 523 Vinol TM partially hydrolyzed polyvinyl acetate, and B-76 Butvar TM polyvinyl butyral as barrier interlayers. These constructions generally have substantial silver and sensitizer stain present that affects the image color separation. The stain problem can be overcome by causing the developed dye image to diffuse from the image-forming layers into a receptor layer that is subsequently stripped from the rest of the construction. The success of this type of approach hinges in large part on the barrier interlayers between the image-forming layers of the tri-pack construction selectively permitting migration of the image-forming dyes while controlling the migration of other image-forming layer components, particularly leuco dyes.

U.S. Pat. No. 4,021,240 shows multiple layers in column 22, lines 7 to 65 and column 23, lines 1 to 57. Interlayers of polyvinyl alcohol are used to preserve the integrity of the color-forming layers. Other hydrophilic polymers, such as gelatin, are also useful. The use of other synthetic polymeric binders alone or in combination as vehicles or binding agents in various layers is also disclosed. Useful resins such as polyvinyl butyral, cellulose acetate butyrate, polymethyl methacrylate, ethyl cellulose, polystyrene, polyvinyl chloride, chlorinated rubber, butadiene-styrene copolymers, and vinyl chloride-vinyl acetate copolymers are also disclosed.

Multicolor photothermographic imaging articles are known in the art with the various color-forming layers separated from each other by functional or nonfunctional barrier layers between the various photosensitive layers. Photothermographic articles having at least two or three distinct color image-forming layers are disclosed in U.S. Pat. Nos. 4,021,240 and 4,460,681.

A process for forming an image in which mobile dyes are released by using the coupling reaction of a reducing agent oxidized by an oxidation-reduction reaction with silver halide or an organic silver salt at high temperature has been described in European Patent No. 79,056, West German Patent No. 3,217,853 and European Patent No. 67,455.

Copending U.S. application Ser. No. 07/775,193 discloses multicolor dry silver imaging constructions that require dye diffusion to an image-receiving layer. No mention is made in that application to the specific polymers employed herein, or to the particular advantages obtained by their use.

Copending U.S. application Ser. Nos. 07/895,045, 07/870,916, and 07/871,005 disclose various dye diffusive dry silver articles employing vinylidene chloride-containing copolymers as interlayer materials for selective dye diffusion.

SUMMARY OF THE INVENTION

In accordance with the present invention, it has been discovered that blends of poly(caprolactone) and poly(vinyl chloride) have high permeability to dyes of widely different chemical structure and dissimilar physical properties such as polarity, solubility, molecular size, and shape, etc. Accordingly, such blends of poly(caprolactone) and poly(vinyl chloride) serve as excellent barrier interlayers or as an image-receiving layer for dye-diffusive photothermographic imaging systems, thereby allowing for a wide choice of image-forming dyes in multi-color (e.g., three color) imaging systems and better color balance in the final image.

Thus, in one embodiment the present invention provides imageable articles having improved image stability comprising: (a) an image-forming layer comprising a source of imaging dye, and (b) an image-receiving layer, wherein a polymeric interlayer is interposed between the image-forming and image-receiving layers, and wherein the polymeric interlayer comprises a blend of poly(vinyl chloride) and poly(caprolactone) having a $T_g$ of at least about 10° C.

In another embodiment, the present invention provides dye diffusive, dry silver photothermographic elements capable of providing improved color separation and print stability comprising a substrate having a dye-receiving layer coated thereon, the dye-receiving layer having coated thereon a plurality of imaging layers comprising an imaging dye, the imaging layers being separated by polymeric interlayers at least one of which comprises a blend of poly(vinyl chloride) and poly(caprolactone) having a $T_g$ of at least about 10° C.

In a further embodiment, the present invention provides dye diffusive dry silver photothermographic elements capable of providing improved color separation and print stability comprising a substrate coated on one surface thereof with an image-receiving layer, the image-receiving layer having coated thereon or in intimate contact therewith at least one image-forming layer comprising a source of imaging dye wherein the image-receiving layer comprises a blend of poly(vinyl chloride) and poly(caprolactone).

The blend of poly(vinyl chloride) and poly(caprolactone) provides a good balance between solvent resistance and dye permeability when used in the present invention. Such a balance of properties is clearly important for the ability of a material to function as a barrier interlayer in the present invention and provides further differentiation of the barrier interlayer materials of the present invention over conventional barrier interlayer materials such as, for example, polyvinyl stearate which exhibits good permeability to various dyes, but rather poor impermeability to coating solvents. Therefore, such a material has poor functional barrier interlayer properties.

Other aspects, advantages, and benefits of the present invention are apparent from the detailed description, the examples, and the claims.

DETAILED DESCRIPTION OF THE INVENTION

The present invention comprises an imageable article having improved image stability that comprises: (a) an image-forming layer comprising a source of imaging dye; and (b) an image-receiving layer, wherein a polymeric interlayer is interposed between the image-forming and image-receiving layer, and wherein the interlayer comprises a blend of poly(vinyl chloride) and poly(caprolactone), the blend or copolymer having a $T_g$ of at least about 10° C.

While single color applications are envisioned, the greatest benefit of the present invention may be obtained in multicolor or full color applications. These typically comprise a substrate having a dye-receiving layer coated thereon, the dye-receiving layer having coated thereon a plurality of imaging layers separated by polymeric interlayers. At least one of the interlayers comprises either a blend of poly(vinyl chloride) and poly(caprolactone).

Alternatively, the image-receiving layer may be supplied as an external component carried on a second substrate that is brought into intimate contact (e.g., laminated) with a first substrate bearing an image-forming layer during processing such that the dye image is transferred from the first substrate to the image-receiving layer. In that case, the laminated construction constitutes an imaged construction according to the present invention.

IMAGE-FORMING LAYER

The image-forming layer may be of any type known in the imaging art in which a colored dye image is formed by the steps of exposure and thermal development. Examples of such image-forming systems include, but are not limited to, silver-ion-leuco dyes, nitrate ion-leuco dyes and diazonium-leuco dye systems.

In a preferred embodiment, the image-forming layer(s) comprises a dry silver composition comprising an intimate mixture of a light-sensitive silver halide; a light insensitive reducible silver source such as a silver salt of an organic acid (e.g., silver behenate, silver saccharine, or silver benzimidazolate) which upon reduction gives a visible change; and a reducing agent. Normally, dry silver compositions further comprise a spectral sensitizer. Such a mixture is usually prepared in a solvent as a dispersion that is spread as a layer on a suitable substrate. When dry, the layer is exposed to a light image and thereafter, a reproduction of the image is developed by heating the coated substrate.

Imaging layer(s) of the present invention may comprise a single coated layer or a plurality of sequentially coated sublayers in which the various components are dispersed. In cases where the imaging layers comprise a plurality of sublayers, the sublayer containing the silver halide is referred to as an emulsion layer.

Silver Halide

Silver halides known in the art for use in photothermography are useful in the present invention and include, but are not limited to, silver chloride, silver chlorobromide, silver chloroiodide, silver bromide, silver iodobromide, silver chloroiodobromide, and silver iodide.

The silver halide used in the present invention may be used as is. However, it may be chemically sensitized with a chemical sensitizing agent such as compounds of sulfur, selenium or tellurium, etc.; compounds of gold, platinum, palladium, rhodium or iridium, etc.; a reducing agent such as tin halide, etc.; or a combination of the foregoing thereof. Details thereof are described in James, T. H. *The Theory of the Photographic Process*, Fourth Ed.; MacMillan: New York, 1977; pp 149-169.

The light sensitive silver halide used in the present invention is typically employed in a range of about 0.01-15 percent by weight, and more preferably in the range of about 0.1 to 10 weight percent, based upon the total weight of each imaging layer in which the silver halide is present.

Sensitizer

The sensitizer employed in the dry silver composition may be any dye known in the photographic art that spectrally sensitizes silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ mole per mole of silver halide.

Light-Insensitive, Reducible Organic Silver Salt

The light-insensitive organic silver salt that can be used in the present invention is a silver salt that is comparatively stable to light and which forms a silver image by reacting with a leuco compound or an auxiliary developing agent that is coexisting with the leuco compound, if desired, when it is heated to a temperature of above 80° C., and preferably, above 100° C. in the presence of exposed silver halide. Suitable organic silver salts include silver salts of organic compounds having a carboxyl group. Preferred examples thereof include silver salts of aliphatic and aromatic carboxylic acids. Preferred examples of silver salts of aliphatic carboxylic acids include silver behenate, silver stearate, silver oleate, silver laurate, silver caproate, silver myristate, silver palmitate, silver maleate, silver fumarate, silver tartarate, silver linoleate, silver butyrate, silver camphorate, and mixtures thereof, etc. Silver salts that are substituted with a halogen atom or a hydroxyl group can also be effectively used. Preferred examples of silver salts of aromatic carboxylic acids and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830; and silver salts of aliphatic carboxylic acids containing a thioether group as described in U.S. Pat. No. 3,330,663. Silver salts of compounds containing mercapto or thione groups and derivatives thereof can be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thio-pyridine-5-carboxylate, silver triazinethiolate, silver 2-sulfidobenzoxazole; and silver salts as described in U.S. Pat. No. 4,123,274. Furthermore, silver salts of a compound containing an amino group can be used. Preferred examples of these compounds include silver salts of benzotriazoles, such as silver benzotriazolate; silver salts of alkyl-substituted benzotriazoles such as silver methylbenzotriazolate, etc.; silver salts of halogen-substituted benzotriazoles such as silver 5-chloro-benzo-triazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like.

The silver halide and the organic silver salt that form a starting point of development should be in reactive association (i.e., in the same layer, in adjacent layers, or layers separated from each other by an intermediate layer having a thickness of less than 1 micron). It is preferred that the silver halide and the organic silver salt are present in the same layer.

The silver halide and the organic silver salt that are separately formed in a binder can be mixed before use to prepare a coating solution, but it is also effective to blend both of them in a ball mill for a long time. Further, it is effective to use a process which comprises adding a halogen-containing compound in the organic silver salt prepared to partially convert the silver of the organic silver salt to silver halide.

Methods of preparing silver halide and organic silver salts and manners of blending them are described in *Research Disclosures* No. 17029 and U.S. Pat. No. 3,700,458.

The light-insensitive, reducible source of silver is preferably present in an amount of from 0.1 to 50 weight percent, and more preferably from about 1-5 weight percent, based upon the total weight of each imaging layer(s) in which the silver source is present.

A suitable coating amount of the light-sensitive silver halide and the organic silver salt employed in the present invention is in a total from 50 mg to 10 g/m$^2$, calculated as an amount of silver as disclosed, for example, in U.S. Pat. No. 4,478,927.

Reducing Agent

Suitable reducing agents for use in the present invention are compounds that oxidize to directly or indirectly form a dye image. In practice of the present invention at least one imaging layer must comprise an image-forming material capable of forming a mobile dye by oxidization. This may be accomplished by substantially any means known in the photothermographic art including, but not limited to, the use of a leuco dye.

Leuco dyes used in the present invention may be any colorless or lightly colored compound that forms a visible dye upon oxidation. The compound must be oxidizable to a colored state. Compounds that are both pH sensitive and oxidizable to a colored state are useful, but not preferred, while compounds only sensitive to changes in pH are not included within the term "leuco dyes" since they are not oxidizable to a colored form.

Preferred neutral leuco dyes are phenolic leuco dyes such as 2-(3,5-di-t-butyl-4-hydroxyphenyl)-4,5-3-diphenylimidazole, or bis(3,5-di-t-butyl-4-hydroxyphenyl)phenylmethane. Other phenolic leuco dyes useful in practice of the present invention are disclosed in U.S. Pat. Nos. 4,374,921; 4,460,681; 4,594,307; and 4,782,010, which are incorporated herein by reference.

The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150 nm, and more preferably, by at least 200 nm. Any leuco dye capable of being oxidized by silver ion to form a visible dye is useful in the present invention as previously noted.

Other leuco dyes may be used in imaging layers as well, for example, benzylidene leuco compounds cited in U.S. Pat. No. 4,923,792, incorporated herein by reference. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ mole-cm liter$^{-1}$, and possess good compatibility and heat stability. The dyes are readily synthesized and the reduced leuco forms of the compounds are very stable. Leuco dyes such as those disclosed in U.S. Pat. Nos. 3,442,224; 4,021,250; 4,022,617 and 4,368,247 are also useful in the present invention.

Another class of dye releasing materials that form a dye upon oxidation are known as preformed-dye-release (PDR) or redox-dye-release (RDR) materials. In these materials, the reducing agent for the organic silver compound releases a preformed dye upon oxidation. Examples of these materials are disclosed in U.S. Pat. No. 4,981,775 incorporated herein by reference.

The dyes generated by the leuco compounds employed in the elements of the present invention are known and are disclosed, for example, in The Colour Index; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; U.S. Pat. No. 4,478,927, and Hamer, F. M. *The Cyanine Dyes and Related Compounds*; Interscience Publishers: New York, 1964; p. 492.

Leuco dye compounds may readily be synthesized by techniques known in the art. Suitable methods are disclosed, for example, in: F. X. Smith et al. *Tetrahedron Lett.* 1983, 24(45), 4951–4954; X. Huang., L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2), 343; and T. Sohda et al. *Chem. Pharm. Bull.* 1983, 31(2) 560–5.

Further, as other image forming materials, materials where the mobility of the compound having a dye part changes as a result of an oxidation-reduction reaction with silver halide, or an organic silver salt at high temperature can be used, as described in Japanese Patent Application No. 165054 (1984). Many of the above-described materials are materials wherein an image-wise distribution of mobile dyes corresponding to exposure is formed in the light-sensitive material by heat development. Processes of obtaining visible images by transferring the dyes of the image to a dye fixing material (diffusion transfer) have been described in the above described cited patents and Japanese Patent Application Nos. 168,439 (1984) and 182,447 (1984).

Still further the reducing agent may be a compound that releases a conventional photographic dye coupler or developer on oxidation as is known in the art. When the heat developable, light-sensitive material used in this invention is heat developed in a substantially water-free condition after or simultaneously with imagewise exposure, a mobile dye image is obtained simultaneously with the formation of a silver image either in exposed areas or in unexposed areas with exposed light-sensitive silver halide.

The total amount of reducing agent utilized in the present invention should preferably be in the range of 1–50 weight percent, and more preferably in the range of 5–20 weight percent, based upon the total weight of each individual layer in which the reducing agent is employed.

The light-sensitive silver halide and the organic silver salt oxidizing agent used in the present invention are generally added to at least one binder as described herein below. Further, the dye-releasing redox compound is dispersed in the binder described below.

The binder(s) that can be used in the present invention can be employed individually or in combination with one another. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

Preferably, the binder is present in an amount in the range of from 1–99 weight percent, and more preferably, from 20–80 weight percent in each imaging layer in which the binder is employed.

The coating amount of the binder used in the present invention is 20 g or less per $m^2$, preferably, 10 g or less per $m^2$, and more preferably, 7 g or less per $m^2$.

The preferred photothermographic silver containing polymer is polyvinyl butyral, but ethyl cellulose, methacrylate copolymers, maleic anhydride ester copolymers, polystyrene, and butadiene-styrene copolymers can be used where applicable according to the solvents used.

In the photographic light-sensitive material and the dye fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethyl-hydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, and mucophenoxychloric acid, etc.; which may be used individually or as a combination thereof.

Dye-Receiving Layer

Dyes generated during thermal development of light-exposed regions of the emulsion layers migrate under development conditions into an image-receiving or dye-receiving layer wherein they are retained. The dye-receiving layer may be composed of a polymeric material having affinity for the dyes employed. Necessarily, it will vary depending on the ionic or neutral characteristics of the dyes.

Examples of organic polymeric materials used in the dye-receiving material of this invention include polystyrene having a molecular weight of 2,000 to 85,000, polystyrene derivatives having substituents with not more than 4 carbon atoms, poly(vinylcyclohexene), poly(-divinylbenzene), poly(N-vinylpyrrolidine), poly(vinylcarbazole), poly(allylbenzene), poly(vinyl alcohol), polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone Bisphenol A polycarbonate, polycarbonates, polyanhydrides, polyamides and cellulose acetate. The synthetic polymers described in "*Polymer Handbook*", 2nd Edition (edited by J. Brandrup and E. H. Immergut, published by John Wiley and Sons, Inc.) are also useful. These polymeric substances may be used singly, or a plurality of them may be used in the form of a copolymer.

Blends of poly(caprolactone) and poly(vinyl chloride) may also be used in the dye-receiving layer of the present invention. It is thought that any relative amount of each polymer in the blend can be used in the dye- or image-receiving layer. The $T_g$ of the polymer blend is not thought to be critical in this embodiment of the present invention.

Interlayers

Interlayers employed in the present invention are selected from polymeric materials that are permeable to dyes used to form the developed image. They are preferably coated from solvents in which the previously coated emulsion layer is not soluble. At least one of the interlayers employed in the present invention must be a blend of poly(caprolactone) and poly(vinyl chloride). The weight of poly(caprolactone) in the blend should be from about 5 to 35 wt %, preferably from about 5 to 30 wt %. The weight of poly(vinyl chloride) in the blend should be from about 65 to 95 wt % and preferably from about 70 to 95 wt %. The blend should have a $T_g$ of at least about 10° C., and preferably at least about 15° C.

These polymers can be used as interlayers in construction of an at least two, and preferably at least three, color photothermographic color recording system. This type of construction with the proper-solvent selection is conductive to the use of simultaneous multiple coating techniques with good color separation, and enables the simultaneous thermal development of at least two or at least three individual color forming photothermographic systems having different chemistry, but similar thermal properties.

Preferably, the interlayers employed in the imageable articles of the present invention should be impermeable to the solvent employed in any layers subsequently coated onto it.

The imageable elements of the present invention may optionally be overcoated with a protective coating. Suitable materials for the protective coating include, but are not limited to, polymers that are insoluble in aqueous systems, soluble in some organic solvents, and impervious to certain other organic solvents. The barrier layer may be crosslinked also. This would be preferably done by the inclusion of a latent or activatable crosslinking agent. Crosslinking could then be effected after coating.

The theory of this process is essentially the same for a light-sensitive material comprising a negative emulsion and a light-sensitive material comprising a direct positive emulsion and differs only in that the portion to be developed is an exposed area in one and an unexposed area in the other. Accordingly, even when a direct positive emulsion is used, a dye image providing good color reproducibility is obtained in the same way as in the case of a negative emulsion.

Heating in a substantially water-free condition, as used herein, means heating at a temperature of 80° to 250° C. The term "substantially water-free condition" means that the reaction system is in equilibrium with water in the air, and water for inducing or promoting the reaction is not particularly or positively supplied from exterior to the element. Such a condition is described at page 374 of "*The Theory of the Photographic Process*", 4th Edition (T. H. James, published by Macmillan Co.).

The coating solution used in this invention may be prepared by separately forming a silver halide and an organic silver salt oxidizing agent, and mixing them before use. It is also effective to mix the two in a ball mill for a long period of time. Another effective method comprises adding a halogen-containing compound to the prepared organic silver salt oxidizing agent, and forming silver halide by the reaction of the halogen-containing compound with silver in the organic silver salt oxidizing agent.

The various layers comprising the imageable articles of the present invention may contain surface active agents for various purposes, for example, as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhdric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol-type nonionic surface active agents having a repeating unit of ethylene oxide in their molecules are often preferably incorporated into the light-sensitive material. It is particularly preferred that the molecule contains 5 or more of the recurring units of ethylene oxide.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

The imageable articles the present invention are coated on a substrate. Suitable substrates include rigid and flexible substrates; metals (for example, steel and aluminum plates, sheets, and foils); films or plates composed of various film-forming synthetic or high polymers including addition polymers (for example, polyvinylidene chloride, polyvinyl chloride, polyvinyl acetate, polystyrene, and polyisobutylene), and linear condensation polymers (for example, polyethylene terephthalate, polyhexamethylene adipate, and polyhexamethylene adipamide/adipate); nonwoven wood by product based substrates such as paper and cardboard; and glass. Substrates may be transparent or opaque.

Especially useful substrates are films of cellulose acetate films such as cellulose triacetate or diacetate, films of polyamides derived from a combination of heptamethylenediamine and terephthalic acid, a combination of fluoroenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film, and a polycarbonate film.

The films may be modified; for example, polyethylene terephthalate films modified by such modifiers as cyclohexanedimethanol, isophthalic acid, methoxypolyethylene glycol, or 1,2-dicarbomethoxybenzenesulfonic acid are effective.

The substrate used for the light-sensitive material in the present invention is one that has good dimensional stability at the processing temperature. The polyesters described in U.S. Pat. No. 3,634,089 are preferably used. More preferably, a polyethylene terephthalate film is used.

If necessary, two or more layers may be applied at the same time by the method as described in U.S. Pat. No. 2,761,791 and British Patent No. 837,095.

In the present invention, the latent image obtained after exposure of the heat-sensitive material can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful. Heating may be carried out by the typical heating means such as a hot plate, an iron, a hot roller, a heat generator using carbon or titanium white, or the like.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye-receiving layer or a layer provided above the dye-receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The following non-limiting examples further illustrate the present invention.

EXAMPLES

Materials used in the following examples were available from standard commercial sources such as Aldrich Chemical Co. (Milwaukee, Wi.) unless otherwise specified.

The poly(vinyl chloride) utilized was VC-106PM from Borden. It had an inherent viscosity (I.V.) of 1.36 in methyl ethyl ketone at 0.2 g/dl. The poly(caprolactone) utilized was available from Polysciences, Inc. (MW=35,000 to 45,000) and had an I.V. of 0.62 measured in MEK at 0.2 g/dl.

The green sensitizing dye used in Examples 1, 2, and 3 is disclosed in U.S. Pat. No. 4,476,220 and has the following formula:

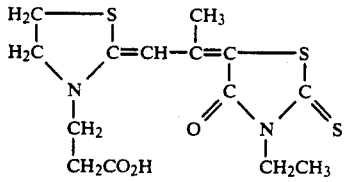

The blue sensitizing dye used in Examples 1, 2, and 3 is disclosed in U.S. Pat. No. 4,123,282 and has the following structural formula:

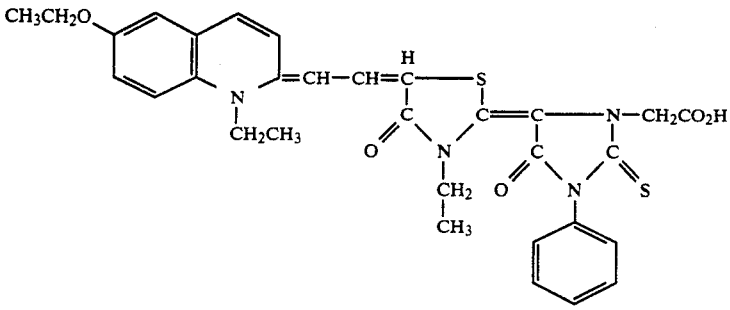

Isobutyl syringketazine has the following structure:

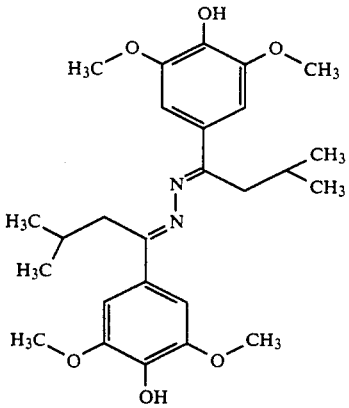

The red sensitizing dye used in Example 1 is disclosed in U.S. Pat. No. 3,719,495 and has the following structural formula:

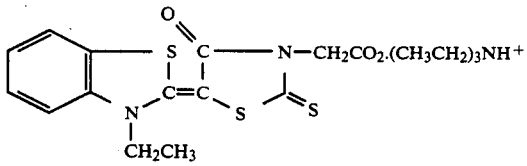

EXAMPLE 1

A 15% solution of a copolymer of vinylchloride (90%) and vinylacetate (10%) (UCAR VYNS-3 from Union Carbide) in methyl ethyl ketone was coated at a wet thickness of 0.08 mm onto an opaque polyester film (Melinex Type 994 from ICI Films) and dried in an oven at a temperature of 80° C. for five minutes to form an image-receiving layer.

A 10% dispersion of silver behenate half soap (1 mole of silver behenate to 1 mole of behenic acid) in cosolvent of toluene (10%) and ethyl alcohol (90%) was made by a homogenization process. 110 g of the 10% half soap dispersion was diluted with 380 g of ethyl alcohol. 0.4 g of poly(vinyl butyral) (Butvar B-76 from Monsanto) was then added to the dilute dispersion and dissolved.

10 cc of 0.05 mole mercury bromide in methyl alcohol was added to the dispersion with stirring. After four hours, to the dispersion, 29 g of poly(vinyl butyral) was added and dissolved. This dispersion will hereinafter be referred to as Dispersion A.

Three drops of a fluorocarbon coating additive (FLOURAD FC431 from 3M Company) as a stripping agent were added to 25 g of Dispersion A and the resulting dispersion mixed. The resulting mixed dispersion was coated over the image-receiving layer at a wet thickness of 0.08 mm and dried in an oven at a temperature of 80° C. for five minutes to form a strippable emulsion layer.

The following polymer solutions were coated over the emulsion layer at a wet thickness of 0.08 mm and dried in an oven at a temperature of 80° C. for five minutes to form a barrier interlayer:

Sample:

1. 3.5% solution poly(vinyl chloride) (VC106PM from Borden) in tetrahydrofuran.
2. 3.5% solution of blend of poly(vinyl chloride) (90%) and poly(caprolactone) (from Polysciences, Inc.) (10%) in tetrahydrofuran.
3. 3.5% solution of blend of poly(vinyl chloride) (80%) and poly(caprolactone) (20%) in tetrahydrofuran.
4. 3.5% solution of blend of poly(vinyl chloride) (70%) and poly(caprolactone) (30%) in tetrahydrofuran.
5. 3.5% solution of blend of poly(vinyl chloride) (65%) and poly(caprolactone) (35%) in tetrahydrofuran.
6. 3.5% solution of blend of poly(vinyl chloride) (60%) and poly(caprolactone) (40%) in tetrahydrofuran.
7. 3.5% solution of blend of poly(vinyl chloride) (50%) and poly(caprolactone) (50%) in tetrahydrofuran.
8. 3.5% solution of blend of poly(vinyl chloride) (25%) and poly(caprolactone) (75%) in tetrahydrofuran.
9. 3.5% solution of poly(caprolactone) in tetrahydrofuran.
10. 3.5% solution of copolymer of vinyl chloride (90%) and vinylacetate (10%) (UCAR VYNS-3 from Union Carbide) in tetrahydrofuran.

11. 3.5% solution of blend of poly(vinyl chloride) (90%) and poly(vinylacetate) (AYAF from Union Carbide) (10%) in tetrahydrofuran.

Color emulsions which are described below were coated over the barrier interlayer.

Cyan emulsion 0.3 g of cyan leuco dye, 3,6-bis(diethylamino)-9-(4-methylbenzoyl) phenoxazine (from Hodogaya Chemical) which was pre-dissolved in 3 cc of toluene, a red sensitizing dye (1 cc of a solution containing 0.005 g of dye in 150 cc of toluene and 50 cc of methyl alcohol) and 0.1 g of 4-methyl phthalic acid were added to 25 g of Dispersion A and the resulting dispersion mixed. The resulting mixed dispersion was coated over the barrier interlayer at a wet thickness of 0.13 mm and dried in an oven at a temperature of 80° C. for five minutes to form a cyan emulsion layer.

Magenta emulsion 0.15 g of magenta leuco dye isobutyl syringketazine and 0.12 g of 1(2H)-phthalazinone which were pre-dissolved in 6 cc of ethyl alcohol and 2 cc of toluene, and a green sensitizing dye (1 cc of a solution containing 0.01 g of dye in 100 cc of methyl alcohol) were added to 25 g of Dispersion A and the resulting dispersion mixed. The resulting mixed dispersion was coated over the barrier interlayer at a wet thickness of 0.13 mm and dried in an oven at a temperature of 80° C. for five minutes to form a magenta emulsion layer.

Yellow emulsion

A 10% dispersion of silver behenate half soap (1 mole of silver behenate to 1 mole of behenic acid) in cosolvent of toluene (10%) and ethyl alcohol (90%) was made by a homogenization process. 205 g of the 10% half soap dispersion was diluted with 285 g of ethyl alcohol. 0.4 g of poly(vinyl butyral) was then added to the dilute dispersion and dissolved.

6 cc of 0.05 mole mercury bromide in methyl alcohol was added to the dispersion with stirring and the resulting dispersion mixed for three hours.

8 cc of 0.1 mole zinc bromide in methyl alcohol was then added to the dispersion with stirring and the resulting dispersion was mixed for an hour. 26 g of additional poly(vinyl butyral) was added to the dispersion and dissolved. This dispersion will hereinafter be referred to as Dispersion B.

0.3 g of a yellow leuco dye, 2-(3,5-di-tert-butyl-4-hydroxyphenyl)-4-phenyl-5-(3-nitro-4-ethoxyphenyl-)imidazole and 0.25 g of 1(2H)-phthalazinone which were pre-dissolved in 8 cc of methyl alcohol, and a blue sensitizing dye (1 cc of a solution containing 0.02 g of dye in 100 cc of methyl alcohol) were added to 25 g of Dispersion B and the resulting dispersion mixed. The resulting mixed dispersion was coated over the barrier interlayer at a wet thickness of 0.10 mm and dried in an oven at a temperature of 80° C. for five minutes to form a yellow emulsion layer.

Sheets cut from the resulting articles were divided into two groups. One group was to be used for test of barrier property of the polymers during the solvent coating and drying operations. The other was to be used for test of permeability of the polymers to each dye of the cyan, the magenta and the yellow at an elevated development temperature.

The portion of the element containing the emulsion layers and the barrier interlayer which was not light-exposed and heat-developed was stripped away from the image-receiving layer.

0.5 mole N-bromosuccinimide solution in cosolvent of acetone (50%) and toluene (50%) was dropped (approximately 0.015 cc) on the image-receiving layer.

If the leuco dye has migrated to the image-receiving layer through the barrier interlayer during the solvent coating and drying operations, the migrated leuco is oxidized by the oxidizing agent and colored in the image-receiving layer. If no color is observed in the image-receiving layer when the oxidizing agent was dropped, no leuco dye has migrated to the image-receiving layer and the polymer can function as a barrier interlayer. The results of the test of the barrier property are given in Table 1.

TABLE 1

| Sample | Tg* (°C.) | Barrier (yes or no) |
|---|---|---|
| 1. Poly(vinylchloride) | 87 | yes |
| 2. Blend of poly(vinylchloride) (90%) and poly(caprolactone) (10%) | 62 | yes |
| 3. Blend of poly(vinylchloride) (80%) and poly(caprolactone) (20%) | 40 | yes |
| 4. Blend of poly(vinylchloride) (70%) and poly(caprolactone) (30%) | 18 | yes |
| 5. Blend of poly(vinylchloride) (65%) and poly(caprolactone) (35%) | 10 | yes |
| 6. Blend of poly(vinylchloride) (60%) and poly(caprolactone) (40%) | 0 | no |
| 7. Blend of poly(vinylchloride) (50%) and poly(caprolactone) (50%) | −18 | no |
| 8. Blend of poly(vinylchloride) (25%) and poly(caprolactone) (75%) | −50 | no |
| 9. Poly(caprolactone) | < −100 | no |
| 10. Copolymer of vinylchloride (90%) and vinylacetate (10%) | 79 | yes |
| 11. Blend of poly(vinylchloride) (90%) and poly(vinylacetate) (10%) | 74 | yes |

*Tg was determined by differential scanning calorimetry (DSC) at a heating rate of 10° C. per min.

The other group of the sheets cut from the resulting photothermographic articles, respectively, were exposed to an EG&G sensitometer through a Wratten 25 red, a Wratten 58 green, or a Wratten 47B blue filter for $10^{-3}$ second to produce heat-developable latent images in the emulsion layers and the images were heat-developed at a temperature of 138° C. on a heat blanket for 35 seconds.

The portion of the element containing the photothermographic emulsion layers and the interlayer was then stripped away from the image-receiving layer. Clear dye images were observed to have been diffusion-transferred to the image-receiving layer through the emulsion layers and the barrier interlayer corresponding to the light-exposed areas of the sheets. The reflection densities of the dye images were measured by a densitometer with the complementary filter to the dye. The results of the sensitometer data obtained from each sample are given in Table 2.

TABLE 2

| Sample | Cyan | Magenta | Yellow |
|---|---|---|---|
| 1. Poly(vinylchloride) | | | |
| Dmin | 0.13 | 0.09 | 0.08 |
| Dmax | 2.21 | 1.26 | 0.93 |
| Ergs/cm$^2$ at 0.6 + Dmin | 126 | 288 | 115 |
| 2. Blend of poly(vinylchloride) (90%) and poly(caprolactone) (10%) | | | |
| Dmin | 0.15 | 0.09 | 0.10 |

TABLE 2-continued

| Sample | Cyan | Magenta | Yellow |
|---|---|---|---|
| Dmax | 2.47 | 2.32 | 2.05 |
| Ergs/cm$^2$ at 0.6 D + Dmin | 123 | 166 | 38 |
| 3. Blend of poly(vinylchloride) (80%) and poly(caprolactone) (20%) | | | |
| Dmin | 0.15 | 0.09 | 0.10 |
| Dmax | 2.34 | 2.57 | 2.20 |
| Ergs/cm$^2$ at 0.6 D + Dmin | 162 | 166 | 35 |
| 4. Blend of poly(vinylchloride) (70%) and poly(caprolactone) (30%) | | | |
| Dmin | 0.13 | 0.09 | 0.10 |
| Dmax | 2.08 | 3.14 | 2.33 |
| Ergs/cm$^2$ at 0.6 D + Dmin | 209 | 158 | 42 |
| 9. Poly(caprolactone) | | | |
| Dmin | 0.19 | 0.11 | 0.13 |
| Dmax | 2.06 | 3.05 | 2.43 |
| Ergs/cm$^2$ at 0.6 D + Dmin | 251 | 110 | 35 |
| 10. Copolymer of vinylchloride (90%) and vinylacetate (10%) | | | |
| Dmin | 0.13 | 0.09 | 0.08 |
| Dmax | 2.25 | 2.12 | 1.26 |
| Ergs/cm$^2$ at 0.6 D + Dmin | 125 | 170 | 55 |
| 11. Blend of poly(vinylchloride) (90%) and poly(vinylacetate) (10%) | | | |
| Dmin | 0.13 | 0.09 | 0.08 |
| Dmax | 2.48 | 1.89 | 1.35 |
| Ergs/cm$^2$ at 0.6 D + Dmin | 123 | 203 | 89 |

As used herein, "Dmin" means the minimum optical image density in exposed regions; and "Dmax" means the maximum optical image density in exposed regions. "Ergs/cm$^2$ at $0.6D+D_{min}$" means the photoenergy required to produce an optical image density of 0.60 above $D_{min}$. For example, if the $D_{min}$ is 0.12, "Ergs/cm$^2$ at $0.6D+D_{min}$" means the energy needed to produce an optical image density of 0.72 (0.12+0.60).

As shown by the above results, the blends of poly(vinylchloride) and poly(caprolactone) show enhanced permeability to image dyes, compared to vinylchloride homopolymer, copolymers of vinylchloride and vinylacetate, and blend of poly(vinylchloride) and poly(vinylacetate).

EXAMPLE 2

The image-receiving layer was prepared on an opaque polyester film in the same manner as described in Example 1.

0.10 g of isobutyl syringketazine and 0.05 g of 1(2H)-phthalazinone was pre-dissolved in 3 cc of ethylalcohol and 2 cc of toluene, green sensitizing dye (1 cc of a solution containing 0.01 g of dye in 100 cc of methyl alcohol) and three drops of a fluorocarbon coating additive were added to 25 g of Dispersion A described in Example 1 and the resulting dispersion mixed.

The resulting mixed dispersion was coated over the image-receiving layer at a wet thickness of 0.08 mm and dried in an oven at a temperature of 80° C. for five minutes to form a magenta emulsion layer.

The following polymer solutions were prepared as the barrier interlayer:

Sample 1: 3.5% solution of poly(vinylchloride)

Sample 2: 3.5% solution of blend of poly(vinylchloride) (95%) and poly(caprolactone) (5%).

Sample 3: 3.5% solution of blend of poly(vinylchloride) (90%) and poly(caprolactone (10%).

To 25 g of each polymer solution, 0.1 g of 1(2H)-phthalazinone was added and mixed.

The resulting solution was coated over the magenta emulsion layer at a wet thickness of 0.08 mm and dried in an oven at a temperature of 80° C. for five minutes to form a barrier interlayer.

Yellow emulsion layer was prepared over the barrier interlayer in the same manner as described in Example 1.

Sheets cut from the resulting photothermographic articles, respectively, were exposed to an EG&G sensitometer through a Wratten 58 green or a Wratten 47B blue filter for $10^{-3}$ seconds to produce heat-developable latent images in the emulsion layers and the images were heat-developed at a temperature of 138° C. on a heat-blanket for 30 seconds.

The portion of the element containing the photothermographic emulsion layers and the barrier interlayer was then stripped away from the image-receiving layer.

Clear magenta or yellow dye image was observed to have been diffusion-transferred to the image-receiving layer through the emulsion layers and the barrier interlayer corresponding to the green light or the blue light exposed area of the sheet.

The reflection densities of the dye images were measured by a densitometer with the complementary filter to the dye. The results of the sensitometric data obtained from each sample are given in Table 3.

TABLE 3

| | Sample 1 (control) | Sample 2 | Sample 3 |
|---|---|---|---|
| | Poly(vinylchloride | | |
| | 100% | 95% | 90% |
| Composition of | Poly(caprolactone) | | |
| barrier interlayer | — | 5% | 10% |
| Tg (°C.) | 87 | 73 | 62 |
| Density in Image-Receiving Layer: Magenta (Green Light Exposed Area) | | | |
| Dmin | 0.10 | 0.11 | 0.11 |
| Dmax | 2.21 | 2.39 | 2.48 |
| Ergs/cm$^2$ at 0.6 D + Dmin | 129 | 102 | 105 |
| Yellow (Blue Light Exposed Area) | | | |
| Dmin | 0.11 | 0.16 | 0.16 |
| Dmax | 1.27 | 2.06 | 2.23 |
| Ergs/cm$^2$ at 0.6 D + Dmin | 66 | 17 | 16 |

EXAMPLE 3

The following polymer solutions were prepared and coated at a wet thickness of 0.10 mm onto an opaque polyester film (Melinex type 994 from ICI Films) and dried in an oven at a temperature of 80° C. for five minutes to form an image-receiving layer.

Sample 1: 10% solution of copolymer of vinylchloride (90%) and vinylacetate (10%) (UCAR VYNS-3 from Union Carbide) in tetrahydrofuran.

Sample 2: 10% solution of blend of poly(vinylchloride) (90%) and poly(caprolactone) (10%) in tetrahydrofuran.

Sample 3: 10% solution of blend of poly(vinylchloride) (80%) and poly(caprolactone) (20%) in tetrahydrofuran.

Color emulsions which are described below were coated over the image-receiving layer.

Magenta emulsion

A magenta emulsion was prepared and coated in the same manner as described in Example 1 except for the amounts of the magenta leuco dye and 1(2H)-phthalazinone. 0.10 g of the magenta leuco dye and 0.05 g of 1(2H)-phthalazinone were added to 25 g of Dispersion A.

Yellow emulsion

A yellow emulsion was prepared and coated in the same manner as described in Example 1 except for the amount of 1(2H)-phthalazinone. 0.20 g of 1(2H)-phthalazinone was added to 25 g of Dispersion B.

A topcoat solution which is described below was respectively coated over the magenta emulsion layer or the yellow emulsion layer.

Topcoat solution 2.5 g of 1(2H)-phthalazinone was dissolved in a mixture of 420 g of acetone, 98 g of isopropyl alcohol and 36 g of methyl alcohol. 3.5 g of cellulose acetate (CA-398-6 from Eastman Chemical Prods.) and 8 g of poly(-methyl methacrylate) (Acryloid A-21 from Rohm and Haas) were added to the solution and dissolved. The resulting solution was coated over the magenta emulsion layer or the yellow emulsion layer at a wet thickness of 0.08 mm and dried in an oven at a temperature of 80° C. for five minutes to form a protective topcoat layer.

Sheets cut from the resulting photothermographic articles, respectively, were exposed to an EG&G sensitometer through a Wratten 58 green or a Wratten 47B blue filter for $10^{-3}$ seconds to produce heat-developable latent images in the emulsion layers and the images were heat-developed at a temperature of 138° C. on a heat-blanket for 30 seconds.

The portion of the element containing the photothermographic emulsion layer and the protective topcoat layer was then stripped away from the image-receiving layer.

Clear magenta or yellow dye image was observed to have been diffusion-transferred to the image-receiving layer through the emulsion layer corresponding to the green light or the blue light exposed area of the sheet.

The reflection densities of the dye images were measured by a densitometer with the complementary filter to the dye. The results of the sensitometric data obtained from each sample are given in Table 4.

TABLE 4

| Composition of image-receiving layer | Sample 1 Copolymer of vinylchloride (90%) and vinylacetate (10%) | Sample 2 Blend of poly(vinyl chloride (90%) and poly (caprolactone) (10%) | Sample 3 Blend of poly(vinyl chloride) (80%) and poly (caprolactone) (20%) |
|---|---|---|---|
| $T_g$ (°C.) | 79 | 62 | 40 |
| Density in Image-Receiving Layer | | | |
| Magenta | | | |
| Dmin | 0.09 | 0.08 | 0.08 |
| Dmax | 2.09 | 2.41 | 2.76 |
| Ergs/cm$^2$ at 0.6 D + Dmin | 37 | 48 | 48 |
| Yellow | | | |
| Dmin | 0.15 | 0.09 | 0.11 |
| Dmax | 1.81 | 2.01 | 2.56 |
| Ergs/cm$^2$ at 0.6 D + Dmin | 19 | 36 | 26 |

Reasonable modifications and variations are possible from the foregoing disclosure without departing from either the spirit or scope of the present invention as defined in the claims.

What is claimed is:

1. An imageable article comprising: (a) an image-forming layer comprising a source of imaging dye; and (b) an image-receiving layer, wherein a polymeric interlayer is interposed between said image-forming layer and said image-receiving layer and wherein said polymeric interlayer comprises a blend of poly(vinyl chloride) and poly(caprolactone), said blend having a $T_g$ of at least about 10° C.

2. The imageable article according to claim 1 wherein said image-forming layer further comprises a light-insensitive, reducible silver source; a light-sensitive silver halide; an polymeric binder; and a sensitizer.

3. The imageable article according to claim 2 wherein said light-insensitive, reducible silver source comprises a silver salt of an aliphatic carboxylic acid.

4. The imageable article according to claim 3 wherein said light-insensitive, reducible silver source comprises silver behenate.

5. The imageable article according to claim 2 wherein said light-sensitive silver halide comprises silver bromide, silver iodide, or silver chloride.

6. The imageable article according to claim 1 wherein said source of imaging dye is a leuco dye.

7. The imageable article according to claim 2 wherein said image-forming layer further comprises toning agent.

8. The imageable article according to claim 1 wherein said poly(caprolactone) is present in said blend in an amount of from about 5 to 35 wt % and said poly(vinyl chloride) is present in said blend in an amount of from about 65 to 95 wt %.

9. The imageable article according to claim 8 wherein said poly(caprolactone) is present in said blend in an amount of from about 5 to 30 wt % and said poly(vinyl chloride) is present in said blend in an amount of from about 70 to 95 wt %.

10. The imageable article according to claim 1 wherein said copolymer or blend has a $T_g$ of at least about 15° C.

11. A dry silver photothermographic element comprising a substrate having a dye-receiving layer coated thereon, said dye-receiving layer having coated thereon a plurality of imaging layers comprising a light-insensitive, reducible silver source; a light-sensitive silver halide; a polymeric binder; a sensitizer; and an imaging dye, the imaging layers being separated by polymeric interlayers at least one of which comprises a blend of poly(vinyl chloride) and poly(caprolactone), said blend having a $T_g$ of at least about 10° C.

12. The dry silver photothermographic element according to claim 11 wherein said blend has a $T_g$ of at least about 15° C.

13. The dry silver photothermographic element according to claim 11 wherein light-insensitive, reducible silver source comprises a silver salt of an aliphatic carboxylic acid.

14. The dry silver photothermographic element according to claim 13 wherein said light-insensitive, reducible silver source comprises silver behenate.

15. The dry silver photothermographic element according to claim 11 wherein said light-sensitive silver halide comprises silver bromide, silver iodide, or silver chloride.

16. The dry silver photothermographic element according to claim 11 wherein one image-forming layer comprises a yellow-forming dye; one image-forming layer comprises a magenta-forming dye; and one image-forming layer comprising a cyan dye.

17. The dry silver photothermographic element according to claim 11 wherein each of said image-forming layers further comprises toning agent.

18. The dry silver photographic element according to claim 11 wherein said poly(caprolactone) is present in said blend in an amount of from about 5 to 35 wt % and said poly(vinyl chloride) is present in said blend in an amount of from about 65 to 95 wt %.

19. The dry silver photothermographic element according to claim 18 wherein said poly(caprolactone) is present in said blend in an amount of from about 5 to 30 wt % and said poly(vinyl chloride) is present in said blend in an amount of from about 70 to 95 wt %.

20. A dye-diffusive dry silver photothermographic element comprising a substrate on one side thereof coated with an image-receiving layer, said image-receiving layer having coated thereon at least one image-forming layer comprising a light-insensitive, reducible silver source; a light-sensitive silver halide; a polymeric binder; a sensitizer; and a source of imaging dye wherein said image-receiving layer comprises a blend of poly(vinyl chloride) and poly(caprolactone).

21. The photothermographic element according to claim 20 wherein said light-insensitive, reducible silver source comprises a silver salt of an aliphatic carboxylic acid.

22. The photothermographic element according to claim 21 wherein said light-insensitive, reducible silver source comprises silver behenate.

23. The photothermographic element according to claim 21 wherein said light-sensitive silver halide comprises silver bromide, silver chloride, or silver iodide.

24. The photothermographic element according to claim 20 wherein said source of imaging dye is a leuco dye.

25. The photothermographic element according to claim 21, wherein said image-forming layer further comprises toning agent.

* * * * *